United States Patent [19]

Nye

[11] 4,413,770

[45] Nov. 8, 1983

[54] RURAL MAILBOX

[76] Inventor: Beatrice E. Nye, R.F.D. #1, Fitchville, Conn. 06334

[21] Appl. No.: 240,562

[22] Filed: Mar. 4, 1981

[51] Int. Cl.[3] ..... B65D 91/00; E06B 7/16

[52] U.S. Cl. ..... 232/17; 232/38; 49/488

[58] Field of Search ..... 232/45, 17, 1 A, 1 C, 232/44, 20, 21, 22, 24; 49/495, 486, 480, 481, 488; 160/354; 119/1

[56] References Cited

U.S. PATENT DOCUMENTS

| | | | |
|---|---|---|---|
| 1,483,077 | 2/1924 | Cole . | |
| 1,688,458 | 10/1928 | Eveleth | 49/489 |
| 2,267,072 | 12/1941 | Beggs . | |
| 3,024,504 | 3/1962 | Miller | 49/495 |
| 3,144,984 | 8/1964 | Ross . | |
| 3,208,668 | 9/1965 | Dickins . | |
| 3,706,411 | 12/1972 | Klein | 232/17 |
| 3,880,344 | 4/1975 | Earle . | |
| 4,223,828 | 9/1980 | Whitley et al. | 232/45 |
| 4,244,512 | 1/1981 | Wise | 232/17 |
| 4,308,989 | 1/1982 | Elsinger | 232/1 C |

FOREIGN PATENT DOCUMENTS

| | | | |
|---|---|---|---|
| 2941772 | 4/1981 | Fed. Rep. of Germany | 49/488 |

*Primary Examiner*—Gene Mancene
*Assistant Examiner*—John Weiss
*Attorney, Agent, or Firm*—Albert W. Hilburger

[57] ABSTRACT

A door for gaining access to a rural mailbox. The door is hinged adjacent to the roof of the mailbox to permit its swinging movement both into and out of the mailbox and, if desired, the door may be weighted to assure its automatic closure when left unattended. A continuous seal composed of a resilient, flexible material is provided around the outer edge of the door to provide all-weather protection for the contents of the mailbox.

10 Claims, 9 Drawing Figures

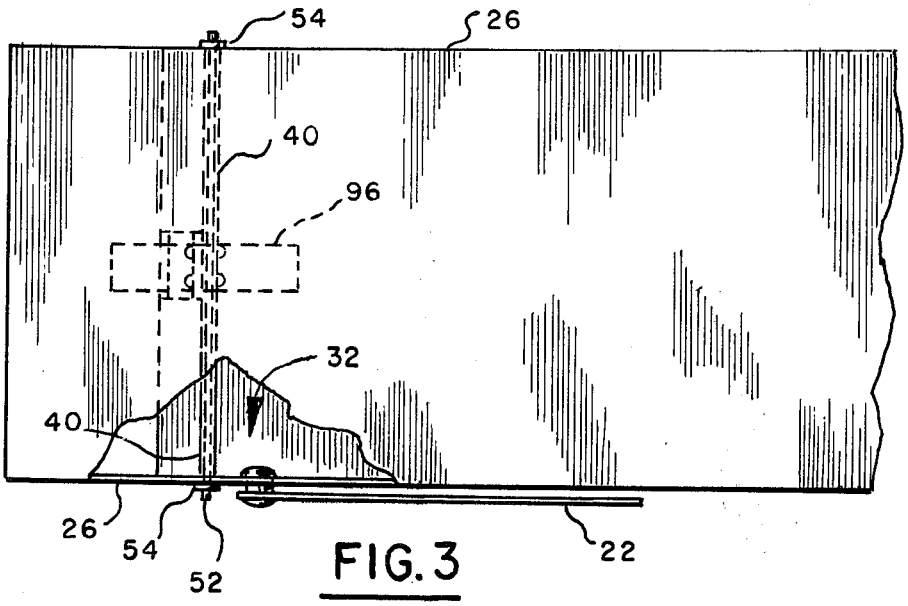
FIG. 3
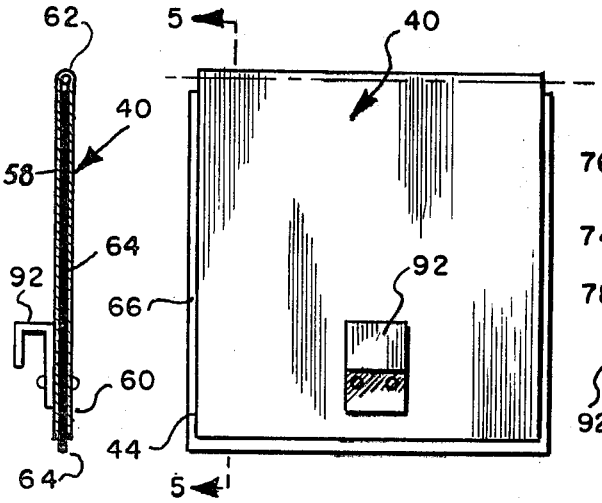
FIG. 5
FIG. 4
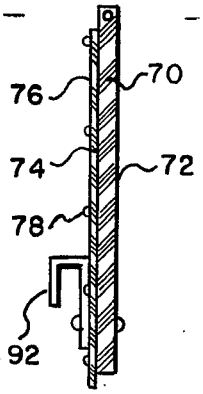
FIG. 7
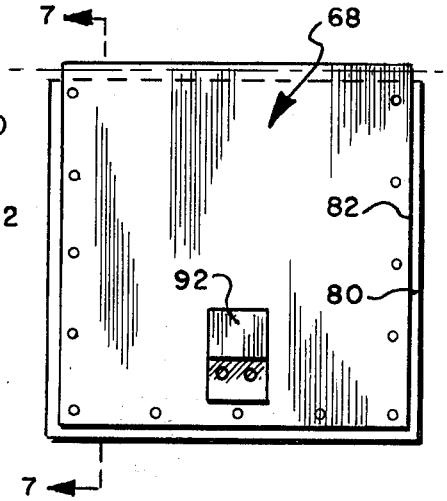
FIG. 6
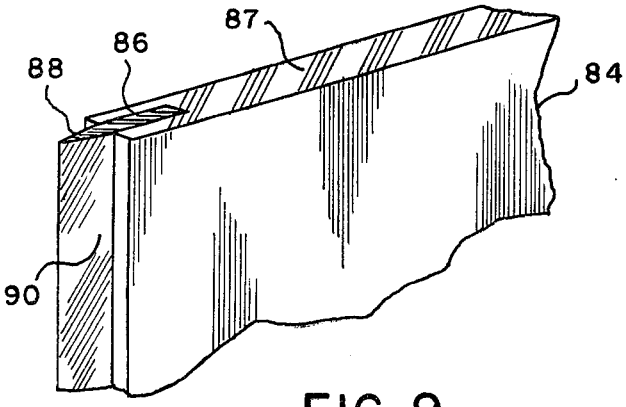
FIG. 8
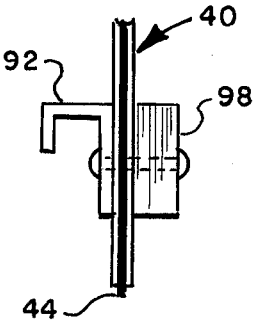
FIG. 9

RURAL MAILBOX

BACKGROUND OF THE INVENTION

1. Field of the Invention

The present invention relates generally to improvements in rural mailboxes and, more particularly, to an improved closure for rural mailboxes.

2. Description of the Prior Art

Over the years, there have been a variety of attempts to improve the quality of rural mailboxes, particularly those which are used in the more northerly climates and thereby subject to a greater temperature variation as well as the rigors of ice and snow. Typical of mailbox constructions which have been known to the prior art are those disclosed in the U.S. patents to Beggs, U.S. Pat. No. 2,267,072 issued Dec. 23, 1941, and to Dickins, Sr., U.S. Pat. No. 3,208,668, issued Sept. 28, 1965. Each of these patents discloses a door hinged about its base and an appropriate handle to enable the door to swing downwardly to an open position, then upwardly to be returned to a closed position. In the patent to Cole, U.S. Pat. No. 1,483,077 issued Feb. 12, 1924, a mailbox is disclosed which is provided with a carriage moveable between an extended position for receiving or removal of mail and a retracted position. In the course of the movement of the carriage, a door D swings upwardly about an upper hinge to an open position as the carriage is extended and, similarly, swings downwardly to a closed position as the carriage is retracted.

Still another mailbox construction is disclosed in the patent to Earle, U.S. Pat. No. 3,880,344, issued Apr. 29, 1975. In Earle, a mailbox 10 employs a door 23 which is generally in the form of a butterfly valve for receiving, although for not discharging, mail. The mail is subsequently retrieved via another door 32.

The patent to Ross, U.S. Pat. No. 3,144,984, issued Aug. 18, 1964, discloses a detachable weather shield for an open ended newspaper box 10. As presented in the patent, the weather shield, which is designed for attachment in some fashion to an open end of the box, is provided with a gate 20 integral with a bight 18 of the shield. The gate 20 is fabricated of a flexible material and suspended from the bight 18 at some distance from the end of the box 10 when the shield is in its final position. Being resilient, the gate is said to be swingable to allow insertion or removal of a newspaper.

With proper deference being given to the aforesaid patents, each of which, on its face, disclosed advances in the state-of-the-art of mailbox construction and closure devices therefor, when each respective patent was granted, nonetheless, the present invention is deemed to be a considerable improvement over such known devices. Indeed, it was with recognition of the need and of the state of the prior art that the present invention was conceived and has now been reduced to practice.

SUMMARY OF THE INVENTION

To this end, apparatus is disclosed including a door for gaining access to a rural mailbox. The door is hinged adjacent to the roof of the mailbox to permit its swinging movement both into and out of the mailbox and, if desired, the door may be weighted to assure its automatic closure when left unattended. A continuous seal composed of a resilient, flexible material is provided around the outer edge of the door to provide all-weather protection to the contents of the mailbox.

The invention presents a number of features. In a first instance, by reason of the fact that the door is pivoted at its upper end, it closes automatically when left unattended. Such automatic operation may be further improved by providing a weight to the door at its lower regions. A handle may also be provided in order to aid in opening and closing the door and a further benefit of the door resides in the fact that it can be either swung into the mailbox or swung out of the mailbox, as desired.

Furthermore, the invention is inexpensive to manufacture and maintain, it is manufactured of readily obtainable materials, and conforms to official U.S. Post Office requirements.

As disclosed, the invention provides a construction which is easy for a postal person to insert mail into the mailbox and for an owner to retrieve mail from the mailbox. Additionally, the primary feature of the invention resides in the construction which provides all-weather protection for contents of the mailbox. In this regard, the flexible outer edge provided on the door not only protects the contents of the mailbox but aids against the door freezing in the closed position during the winter time.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate one embodiment of the invention and, together with the description, serve to explain the principles of the invention.

DETAILED DESCRIPTION OF THE DRAWINGS

In the drawings:

FIG. 3 is a detailed top plan view, certain parts being cut away and shown in section;

FIG. 4 is a front elevation view of one embodiment of a door utilized by the invention;

FIG. 5 is a cross-section view taken generally along line 5—5 in FIG. 4;

FIG. 6 is a front elevation view of another embodiment of a door utilized by the invention;

FIG. 7 is a cross-section view taken generally along line 7—7 in FIG. 6;

FIG. 8 is a detailed perspective view of still another embodiment of a door utilized by the invention; and FIG. 9 is a detailed side elevation view of still another embodiment of a door utilized by the invention.

DESCRIPTION OF THE PREFERRED EMBODIMENT

Figure 1:
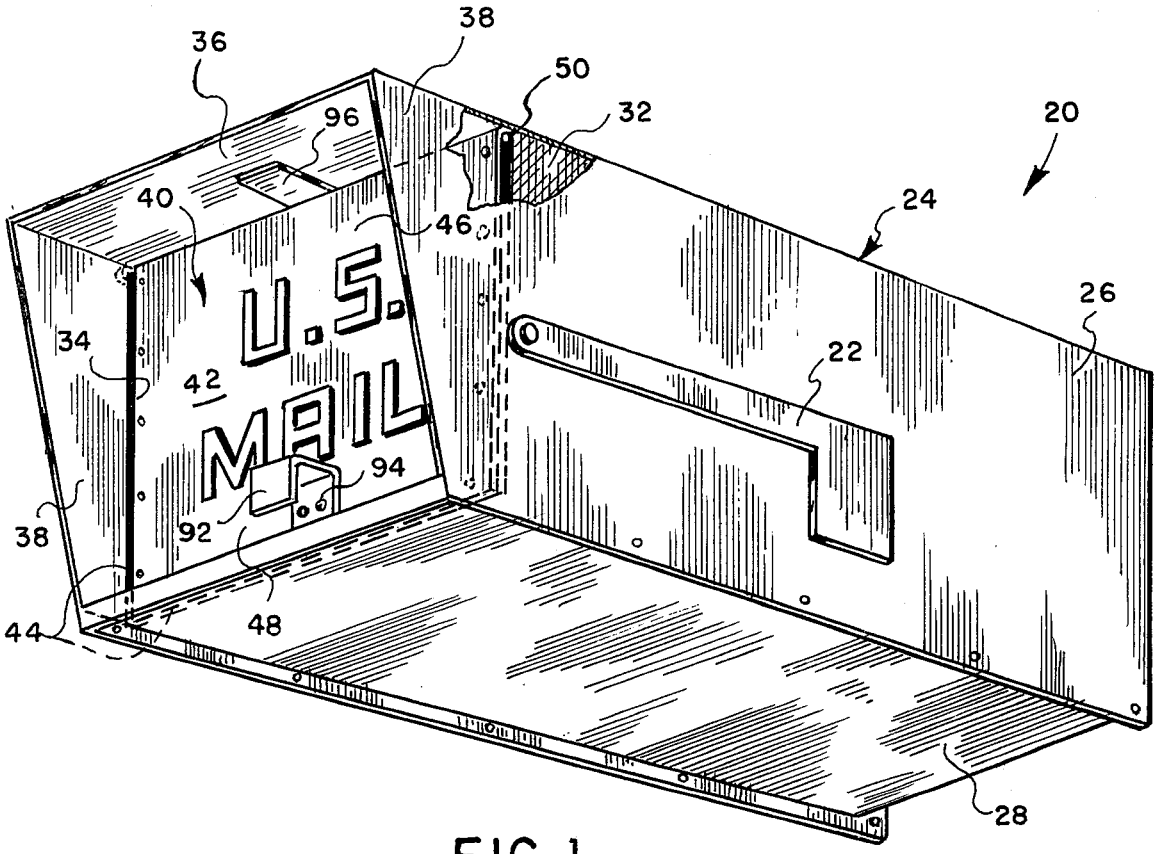
FIG. 1 is a perspective view of a mailbox incorporating a closure which embodies the principles of the present invention.

Refer now to the drawings, and initially to FIG. 1, which generally illustrates a mailbox 20 embodying the principles of the invention. The mailbox 20 is generally considered to be of the variety which is generally utilized by rural residences for the delivery of mail and which employs a flag 22 which is moveable between a raised position to indicate the presence of mail in the mailbox and the lowered position (as shown) to indicate the absence of such mail.

In accordance with the invention, the mailbox is disclosed comprising a body including a plurality of sidewalls having inner surfaces defining an interior compartment for receiving and containing mail and an opening into the interior compartment; a door for gaining access to the interior compartment of said body including a central member, a peripheral outer edge defining the limits of said central member, and upper and lower ends; pivot means mounting said door adjacent said upper end within the opening for swinging movement between open and closed positions; said outer edge of said door being proximate to said inner surfaces when said door assumes the closed position; and sealant means fixed to said door continuously along said outer edge of said door for engaging said inner surfaces when said door is in the closed position.

Figure 2:
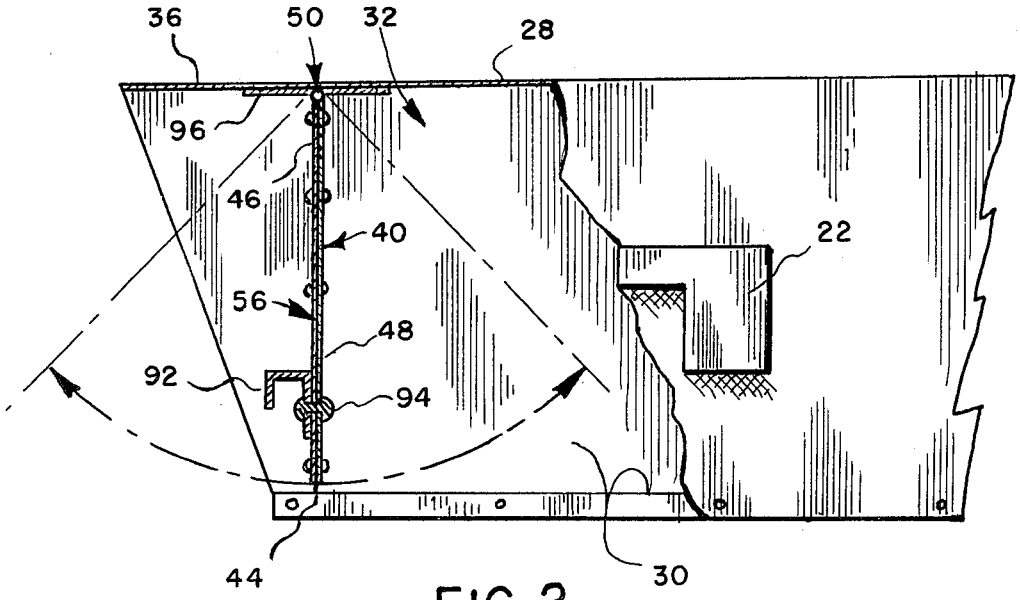
FIG. 2 is a detailed side elevation view of the mailbox illustrated in FIG. 1, certain parts being cut away and shown in section.

As embodied herein, with particular reference now to FIGS. 1, 2, and 3, the mailbox 20 is seen to comprise a body 24 which includes a plurality of sidewalls 26 and 28 having inner surfaces 30 which define an interior compartment 32 for receiving and containing mail. The sidewalls 26 and 28 also define, at one end of the body 24, an opening 34 (FIG. 1) into the interior compartment 32. Preferably, the construction of the body 24 includes a hood 36 and associated side members 38 which serve as some protection for the mail after it has been inserted through the opening 34 and is stored within the compartment 32.

A door 40 is provided at the opening 34 for gaining access to the interior compartment 32. The door 40 includes a central member 42, a peripheral outer edge 44 which defines the limits of the central member 42 and, generally, an upper end 46 and a lower end 48. The door 40 is mounted adjacent its upper end 46 by means of a hinge 50 or other suitable pivot means within the opening 34 so as to swing in the manner shown in FIG. 2 from open positions as indicated by phantom lines either forward of the opening 34 or rearward of the opening 34 and a closed position as indicated by solid lines.

One form of the hinge 50 may be described with the aid of FIGS. 2 and 3. As shown therein, the upper end 46 of the door 40 may be journaled on a shaft 52. In turn, the ends of the shaft 52 may be either fittingly or slideably received through holes (not shown) suitably pierced in the sidewalls 26 and held against axial movement by means of a pair of retainer rings 54.

FIGS. 1 and 2 perhaps most clearly illustrate the construction of the invention in which the outer edge 44 of the door 40 is proximate to the inner surfaces 30 when the door assumes the closed position as indicated by solid lines in FIG. 2. Furthermore, with the door 40 in its closed position, sealant means generally indicated at 56 is fixed to the door continuously along the outer edge 44 and serves to engage the inner surfaces 30 when the door is in the closed position. This sealant means is preferably of a flexible, resilient material such as rubber, polyvinyl chloride, or nylon having sufficient magnitude to fill any space existing between the outer edge 44 and the inner surfaces 30 when the door is in the closed position.

In accordance with the invention, the mailbox 20 is generally as previously described wherein said body includes a pair of vertical sidewalls lying, respectively, in generally parallel, spaced apart planes and a pair of horizontal sidewalls lying, respectively, in generally parallel, spaced apart planes, said vertical sidewalls intersecting with said horizontal sidewalls, and wherein said door is rectangular in shape, said outer edge conforming generally to the opening into the interior compartment.

As embodied herein, with continuing reference to FIGS. 1–3 the body 24 includes four integral sidewalls, two of them being vertical sidewalls 26 and two of them being horizontal sidewalls 28. The sidewalls 26, therefore lie in planes which are substantially perpendicular to the planes of their adjacent horizontal sidewalls 28. So as to conform to the shape of the resultant opening 34, the door 40 is rectangular in shape and, as previously described, is provided with an outer edge 44 which conforms generally to the opening 34 into the interior compartment 32.

In accordance with the invention, the mailbox 20 is generally as previously described wherein said door is composed of a rigid sheet having generally parallel, spaced apart, front and rear members each having a peripheral outer edge; an integral web joining said front and rear members and wherein said sealant means includes flexible, resilient material interposed between said front and rear members and providing a continuous outer margin which extends beyond said peripheral outer edges and is sufficient in magnitude to fill any space existing between said outer edge of said door and said inner surfaces when said door is in the closed position.

As embodied herein, with particular reference now to FIGS. 4 and 5, one embodiment of the door 40 is presented as being composed of a rigid sheet. The material utilized in the construction of the door may be of any suitable composition, including metals such as aluminum or steel, or of any of a variety of plastic materials. In the construction illustrated in FIGS. 4 and 5, the door 40 includes front and rear members, 58 and 60 respectively, each being provided with the peripheral outer edge 44 previously described. Additionally, an integral web 62 effectively joins the front and rear members 58 and 60 and likely represents the fold line about which the front and rear members 58 and 60 are folded in the event the door is fashioned from a single planar sheet of material. Interposed between the front member 58 and the rear member 60 is a mass of flexible, resilient material 64 which includes a continuous outer margin 66 which extends beyond the peripheral outer edges 44 and is sufficient in magnitude to fill any space existing between the outer edge 44 and the inner surfaces 30 when the door is in the closed position. As previously described, the flexible, resilient material 64 may be of any suitable composition such as polyvinyl chloride, rubber, or nylon.

In accordance with the invention, the mailbox 20 is generally as previously described wherein said door is composed of a rigid sheet having front and rear surfaces and wherein said sealant means includes flexible, resilient material mounted to said rear surface of said door at least proximate to said outer edge of said door, said material providing a continuous outer margin which extends beyond said peripheral outer edge and is sufficient in magnitude to fill any space existing between said outer edge of said door and said inner surfaces when said door is in the closed position.

As embodied herein, and with reference now particularly to FIGS. 6 and 7, a door 68 is illustrated which represents another embodiment of the invention. In this instance, the door 68 is fabricated from a rigid sheet 70 of any suitable composition, including metal or plastic materials. The sheet material 70 has a front surface 72 and a rear surface 74. Preferably, in this embodiment, a sheet of flexible, resilient material 76 of any suitable composition such as those materials previously described, is mounted to the rear surface 74 in any suitable fashion, as by rivets 78 or by suitable adhesive. The material 76 includes a continuous outer margin 80 which extends beyond a peripheral outer edge 82 of the door 68 and is of sufficient magnitude to fill any space existing between the outer edge 82 and the inner surfaces 30 of the body 24 when the door 68 is in the closed position.

In accordance with the invention, the mailbox 20 is generally as previously described wherein said door is composed of a rigid sheet having a continuous groove along said outer edge; and wherein said sealant means includes a continuous strip of flexible, resilient material received within said groove providing a continuous outer margin which extends beyond said outer edge and is sufficient in magnitude to fill any space existing between said outer edge of said door and said inner surfaces when said door is in the closed position.

As embodied herein, with particular reference now to FIG. 8, wherein still another modified door incorporating the principles of the invention is indicated by the reference numeral 84. In this instance, the door 84, as previously, is composed of a rigid sheet of suitable material and is provided with a continuous groove 86 along its outer edge 87. Sealant means is provided in the form of a strip of flexible, resilient material 88 received within the groove 86 providing a continuous outer margin 90 which extends beyond the outer edge 87 and is sufficient in magnitude to fill any space existing between the outer edge of the door 84 and the inner surfaces 30 when the door is in the closed position.

In accordance with the invention, the mailbox 20 is generally as previously described and includes a handle mounted on an outer surface of said door adjacent to said lower end for aiding the movement of said door between its open and closed positions and further includes supplemental weight means mounted on said door adjacent to said lower end biasing said door toward the closed position.

As embodied herein, with particular reference once again to FIGS. 1–3, the mailbox 20 is preferably provided with a handle 92 suitably mounted to the door 40 as by the rivets 94 or in some other suitable fashion. The handle can aid in opening the door and can also serve as a weight which aides in returning the door to the closed position when left unattended. Additionally, a spring 96 fixed to the upper end 46 of the door 40 as by welding or in some other suitable fashion can similarly be employed to bias the door towards the closed position. As seen in FIGS. 1 and 2, the spring 96 lies in a plane generally transverse of the plane of the door. When the door is moved forwardly, the spring bears against the hood 36 and when the door is moved rearwardly, the spring bears against the upper horizontal sidewall 28 and, in either event, serves to return the door to the closed position when the handle 92 is released. It might also be desirable to provide a weight 98 (FIG. 9) which may be similarly mounted to the door and which serves as a supplemental means of biasing the door to the closed position when left unattended.

The invention, in its broader aspects, is not limited to the specific details shown and described; departures may be made from such details without departing from the principles of the invention.

What is claimed is:

1. A mailbox comprising:

a body including a plurality of sidewalls having inner surfaces defining an interior compartment for receiving and containing mail and an opening into the interior compartment;

a door for gaining access to the interior compartment of said body including a central member, a peripheral outer edge defining the limits of said central member, and upper and lower ends;

pivot means mounting said door adjacent said upper end within the opening for swinging movement between a closed position lying substantially in a vertical plane and open positions, one whereby said door is swung forwardly about its upper end out of said compartment and another whereby said door is swung rearwardly about its upper end into said compartment;

said outer edge of said door being proximate to and enveloped by said inner surfaces when said door assumes the closed position and conforming generally to the opening into the interior compartment; and sealant means fixed to said door continuously along said outer edge of said door for engaging said inner surfaces when said door is in the closed position.

2. A mailbox as set forth in claim 1 wherein said body includes a pair of vertical sidewalls lying, respectively, in generally parallel, spaced apart planes and a pair of horizontal sidewalls lying, respectively, in generally parallel, spaced apart planes, said vertical sidewalls intersecting with said horizontal sidewalls, and wherein said door is generally rectangular in shape.

3. A mailbox as set forth in claim 2 wherein said horizontal sidewalls are, respectively, an upper sidewall and a lower sidewall, and wherein said pivot means includes a substantially horizontal shaft extending between said vertical sidewalls adjacent said upper sidewall, said door being journaled on said shaft.

4. A mailbox as set forth in claim 1 wherein said sealant means is of a flexible, resilient material sufficient in magnitude to fill any space existing between said outer edge of said door and said inner surfaces when said door is in the closed position.

5. A mailbox as set forth in claim 1 wherein said door is composed of a rigid sheet having generally parallel, spaced apart, front and rear members, said front and rear members each having a peripheral outer edge; an integral web joining said front and rear members and wherein said sealant means includes flexible, resilient material interposed between said front and rear members and providing a continuous outer margin which extends beyond said peripheral outer edges and is sufficient in magnitude to fill any space existing between said outer edge of said door and said inner surfaces when said door is in the closed position.

6. A mailbox as set forth in claim 1 wherein said door is composed of a rigid sheet having front and rear surfaces and wherein said sealant means includes flexible, resilient material mounted to said rear surface of said door at least proximate to said outer edge of said door, said material providing a continuous outer margin which extends beyond said peripheral outer edge and is sufficient in magnitude to fill any space existing between said outer edge of said door and said inner surfaces when said door is in the closed position.

7. A mailbox as set forth in claim 1 wherein said door is composed of a rigid sheet having a continuous groove along said outer edge; and wherein said sealant means includes a continuous strip of flexible, resilient material received within said groove providing a continuous outer margin which extends beyond said outer edge and is sufficient in magnitude to fill any space existing between said outer edge of said door and said inner surfaces when said door is in the closed position.

8. A mailbox as set forth in claim 1 including a handle mounted on an outer surface of said door adjacent to said lower end for aiding the movement of said door between its open and closed positions.

9. A mailbox as set forth in claim 1 including spring means on said door biasing said door towards the closed position.

10. A mailbox as set forth in claim 1 including supplemental weight means mounted on said door adjacent to said lower end biasing said door towards the closed position.

* * * * *